United States Patent [19]

Willert

[11] Patent Number: 4,524,112

[45] Date of Patent: Jun. 18, 1985

[54] COMPOSITE PROFILED MEMBER

[76] Inventor: Otto Willert, Muehlenstrasse 30, DE-8784 Burgsinn, Fed. Rep. of Germany

[21] Appl. No.: 519,860

[22] Filed: Aug. 3, 1983

[30] Foreign Application Priority Data

Aug. 5, 1982 [DE] Fed. Rep. of Germany ..... 3229229
Aug. 5, 1982 [DE] Fed. Rep. of Germany ..... 3229230

[51] Int. Cl.[3] ..... E06B 1/32

[52] U.S. Cl. ..... 428/595; 49/504; 49/DIG. 1; 52/403; 52/398

[58] Field of Search ..... 49/504, DIG. 1, DIG. 2; 52/403, 393, 398, 396, 235; 428/595, 582

[56] References Cited

U.S. PATENT DOCUMENTS

| | | | |
|---|---|---|---|
| 1,723,306 | 8/1929 | Sipe | 52/403 |
| 2,872,713 | 2/1959 | Haas | 52/398 |
| 3,093,217 | 6/1963 | Doede | 52/403 |
| 3,114,179 | 12/1963 | Briggs | 52/403 |
| 3,336,713 | 8/1967 | Privas | 52/403 |
| 3,908,313 | 9/1975 | Bierlich | 49/DIG. 1 |
| 4,115,972 | 9/1978 | Varlonga | 49/504 |
| 4,423,578 | 1/1984 | Meigs et al. | 49/DIG. 1 |

FOREIGN PATENT DOCUMENTS

| | | | |
|---|---|---|---|
| 2130496 | 12/1972 | Fed. Rep. of Germany | 52/398 |
| 2221179 | 11/1973 | Fed. Rep. of Germany . | |
| 2235392 | 2/1974 | Fed. Rep. of Germany | 49/DIG. 1 |
| 2608329 | 9/1977 | Fed. Rep. of Germany | 49/DIG. 1 |
| 2911832 | 10/1980 | Fed. Rep. of Germany . | |
| 3002693 | 7/1981 | Fed. Rep. of Germany | 52/404 |
| 3133378 | 3/1983 | Fed. Rep. of Germany . | |
| 2005438 | 12/1969 | France | 49/DIG. 1 |
| 411296 | 11/1966 | Switzerland | 52/403 |
| 768499 | 2/1957 | United Kingdom | 49/504 |
| 2013267A | 8/1979 | United Kingdom | 49/DIG. 1 |
| 2107770 | 5/1983 | United Kingdom . | |

*Primary Examiner*—L. Dewayne Rutledge
*Assistant Examiner*—John J. Zimmerman
*Attorney, Agent, or Firm*—Spencer & Frank

[57] ABSTRACT

A composite profile member includes two metal profile bars and at least one thermally insulating, one-piece insulating bar which engages into a clamping groove of the metal profile bars. The insulating bar is fixed in the respective clamping groove by its hook-shaped groove webs which are pressed against the insulating bar, with corresponding centering means being provided at the insulating bar and in the respective clamping groove to assure dimensional accuracy when the groove webs are pressed on. The centering means in the bottom of the respective clamping groove is a centering groove which has a trapezoidal cross section that widens in the direction toward the insulating bar and the centering means in the parts of the insulating bar which engage in the clamping grooves are members which have a trapezoidal cross section that becomes narrower toward the metal profile bars so as to engage in a centering manner in the respective centering groove. Additionally, in their longitudinal direction, the insulating bar and/or the metal profile bars are provided with at least one strip to which can be fastened an elastic center seal, with the strip stiffening the seal and accurately fixing its position while performing a sealing function.

17 Claims, 5 Drawing Figures

COMPOSITE PROFILED MEMBER

BACKGROUND OF THE INVENTION

The invention relates to a heat insulated composite profiled member for the production of structural components such as windows, doors or the like, of aluminum or another metal, with the components being distinguished by dimensional accuracy and tight joints.

An inadvertent compensation between climatic conditions existing inside and outside of a building is counteracted in that the required structural openings are sealed by special structural components. To produce such components, materials are used which have the best possible thermal insulating properties and the joints between frame and sash are closed by special elastic sealing elements. Good heat insulating properties in metal profiled members are attained in that they are separated and an insulating body is inserted between the thus produced shells or bars. This insulating body may be a foamed material or a solid plastic, with the connection between the metal profiled bars and the insulating body being effected by a force-locking connection or by chemical or thermal processes. However, for a force-locking connection it is necessary to insert the insulating body into corresponding recesses or projecting profiled members so that it is held, centered and, in its defined final position, pressed firmly against the metal profiles.

Known solutions of this type (Nos. DE-OS 2,221,179, DE-OS 2,911,832), however, have the drawback that all tongues, undercuts, projections etc. are subject to tolerances inherent in their manufacture, so that with their number increasing, the intended effect of individual parts is not or only partially realized (strength of connection) and the entire geometry and dimensional accuracy of the composite profiled member are adversely influenced.

The seal between the frame and the sash is produced, according to known designs, by circumferential, soft seals in the inner rabbet region (center seal) and soft seals in the region of the exterior abutment. Corresponding to the functions performed by the individual regions of the center seal, their cross sections have a rather varying structure. Such regions have a very elastic head section (abutment region) and a relatively thick-walled foot section, sometimes provided with hollow chambers, with this foot section serving as an anchor for the center seal in the frame. This complicated shape has the result that the miter cut required in the corners of the frame is difficult or impossible to perform. The corners remain untight. It is therefore customary to glue the corners. However, the sometimes curved cut faces cannot be pressed together without deforming the entire geometry of the center seal, and the cyanoacrylate based adhesives employed because of their fast action make the glued corners unelastic. Both reduce the tightness of the joint.

No. DE-OS 3,133,378 discloses the sealing of untight corners by glueing on a "patch".

The above explanations lead to the conclusion that the solution to the two problems, i.e. to tightly seal and thermally insulate structural openings, has in the past been attempted independently of one another by separate means.

SUMMARY OF THE INVENTION

It is therefore the object of the invention to avoid the drawbacks of the known solution proposals and to create a thermally insulated composite profiled member so that windows and doors produced from such a profiled member are characterized by being very dimensionally accurate with tight joints.

To solve this problem, the invention is based on a composite profiled member which comprises two metal profiled bars and at least one thermally insulating, one-piece insulating bar which engages into a clamping groove in the metal profiled bars, with the insulating bar being fixed in the respective clamping groove by hook-shaped groove webs which define the sides of the clamping groove and which are pressed against the insulating bar. Mutually corresponding centering means are provided on the insulating bar and in the clamping groove to assure dimensional accuracy when the groove webs are pressed onto the insulating bar. The invention resides in that the bottom of each respective clamping groove is provided with a centering groove having a trapezoidal cross section which widens in the direction toward the insulating bar; that the portions of the insulating bar which engage in the clamping grooves have a section which has a trapezoidal cross section which becomes narrower toward the metal profiled bars and centeringly engages in the respective centering groove and that the insulating bar and/or the metal profiled bars are provided, in their longitudinal direction, with at least one strip or rib to which an elastic center seal can be fastened so as to stiffen and precisely fix the position of this seal, with the strip performing a sealing function. The trapezoidal centering groove makes it possible to omit positive guidance means which are affected by tolerances and to produce a connection merely by force-lockingly pressing together and engaging two groove webs provided on each metal profiled bar which are brought into their final position by a machine. The trapezoidal centering groove also makes it possible to produce the final composite profiled member with great machine-set dimensional accuracy. Moreover, the strip or rib provided on the insulating bar and/or on the metal profiled bars stiffens the elastic center seal in such a way that the miter cut can be performed by machine and thus the window becomes very tight. The great tightness is further realized by the fact that the strip in part also performs a sealing function.

BRIEF DESCRIPTION OF THE DRAWINGS

One embodiment of the invention is illustrated in the drawings wherein.

DETAILED DESCRIPTION OF THE PREFERRED EMBODIMENTS

Figure 1:
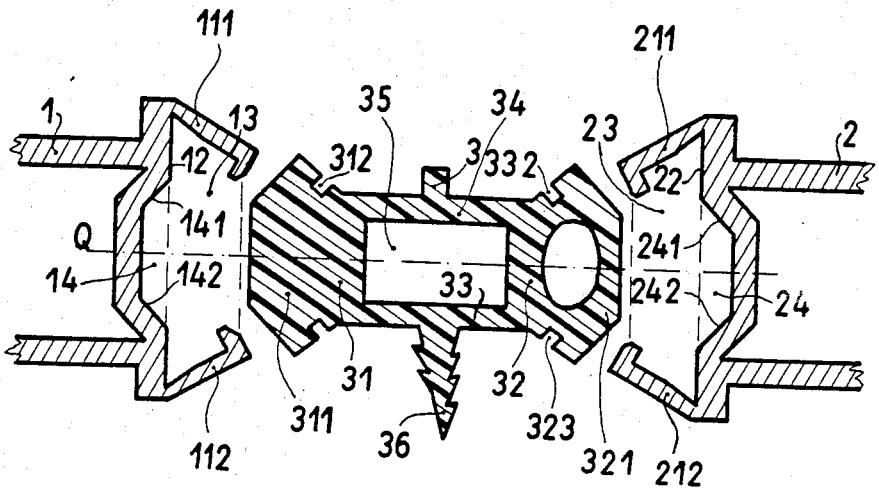
FIG. 1 is an expanded sectional view of the composite profiled member assembled of two metal profiled bars and an insulating bar.

FIG. 1 is an expanded sectional view of the composite profiled member comprising the two metal profiled bars 1, 2 and an insulating bar 3. The insulating bar 3 is made of a thermally insulating material and is of one piece construction. Plastics are preferably used as the thermally insulating material. Only the sides of the metal profiled bars 1, 2 facing the insulating bar 3 are shown. At these sides, the metal profile bars 1, 2 are provided with clamping grooves 13 and 23, respectively comprising respective hook-shaped groove webs 111, 112, and 211, 212, and the respective clamping groove bottom 12 or 22. In each clamping groove bottom 12, 22, there is provided a respective centering groove 14, 24 which has a trapezoidal cross section that widens in the direction toward the insulating bar 3.

On both sides when seen in the direction toward the metal profiled bars 1, 2, insulating bar 3 is provided with members 31, 32 which engage into clamping grooves 13, 23 respectively, and are themselves provided with members 311, 321 having a trapezoidal cross section which becomes narrower toward the metal profiled bars 1, 2. These trapezoidally tapered members 311, 321 centeringly engage in the respective centering grooves 14, 24. Hook grooves 312, 313, 322, 323, into which are pressed the respective hook-shaped groove webs 111, 112, 211, 212, may also be cut into members 31, 32. However, it is also possible, if the thermal insulation material of which insulating bar 3 is made is soft enough, to omit the hook grooves 312, 313, 322, 323 and to press groove webs 111, 112, 211, 212 directly into members 31, 32. Insulating bar 3 additionally includes crossbars 33, 34 which, together with members 31, 32 enclose a cavity 35.

Figure 2:
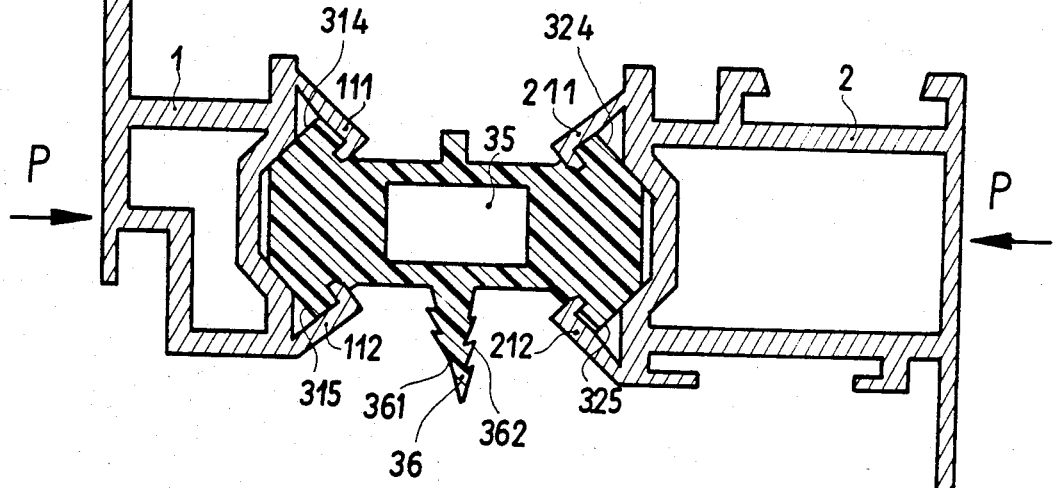
FIG. 2 is a sectional view of the assembled composite profiled member.

FIG. 1 also shows the insulating bar 3 having a solid member 31 and a tubular member 32. This is merely intended to show two embodiments which, however, are not used simultaneously but alternatively, i.e. either both members 31 and 32 are solid or they are both tubular. A tubular member 32 at both sides of insulating bar 3 has the advantage that during centering of the metal profile bars 1, 2 and insulating bar 3 by means of pressure, shown in FIG. 2 by arrows P, member 32 is, to a slight degree, more easily compressible and thus the exterior dimensional accuracy of the complete composite profile member can be maintained more precisely. FIG. 2 shows the completely installed composite profiled member with the groove webs 111, 112, 211, 313 resting against insulating bar 3.

Preferably, the walls 141, 142 and 241, 242 of respective centering groove 14, 24 are parallel to faces 314, 315 and 324, 325 (FIG. 2) of insulating bar 3 with which they centeringly cooperate. It is also possible, however, for the acute angle formed by faces 314, 315 and 324, 325, respectively, to be larger by a small amount than the acute angle formed by faces 141, 142 and 241, 242, respectively.

When the composite profiled member is produced, the insulating bar 3 pushed into clamping grooves 13, 14 is first centeringly pressed into the respective centering grooves 14, 24 by pressing the metal profile bars 1, 2 from the outside in the direction of arrows P and then, by pressing or rolling, i.e., deforming, the groove webs 111, 112, 211, 212 into or against members 31, 32, insulating bar 3 is combined with the metal profiled bars 1, 2 to form a rigid unit.

Figure 3:
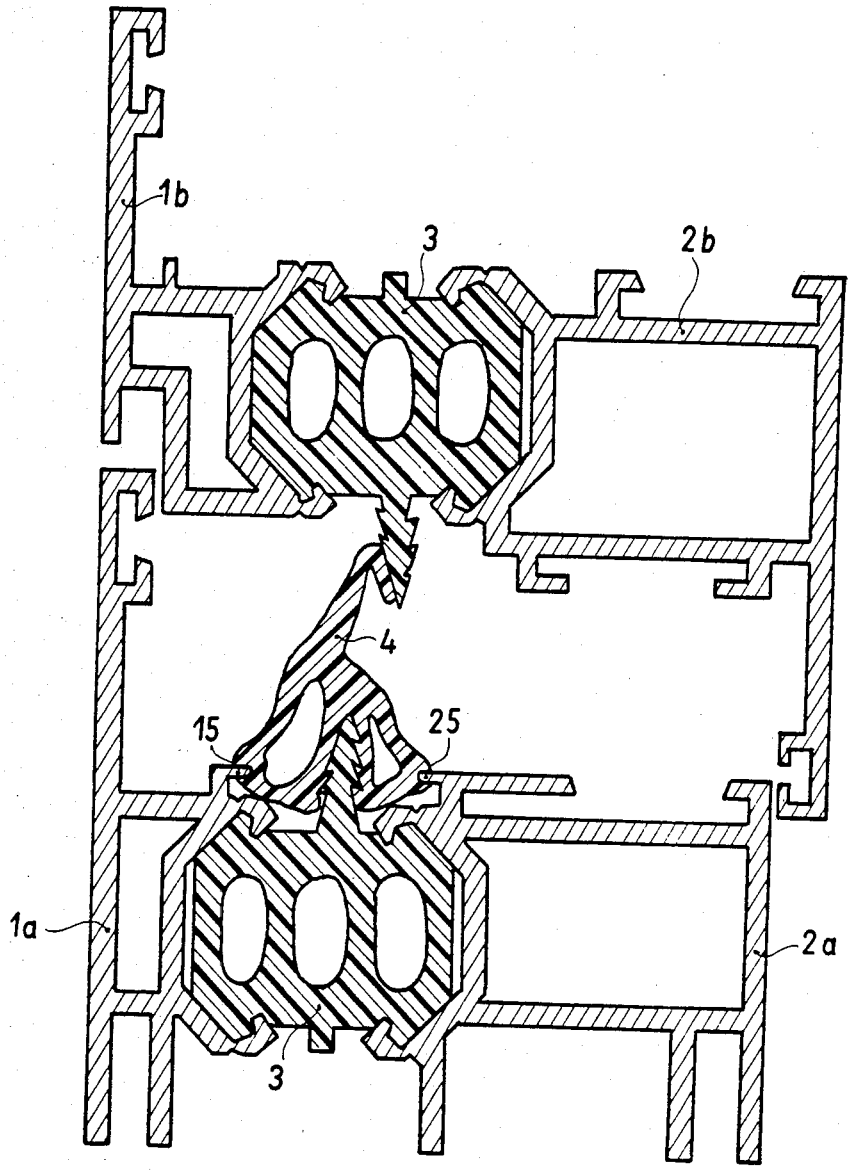
FIG. 3 is a sectional view of a window comprising the composite profiled members according to FIGS. 1 and 2, including the attached center seal.

The cross-sectional shape of members 31, 32 of insulating bar 3 which engage in clamping grooves 13, 23, is designed to be symmetrical with respect to the transverse axis Q to the longitudinal direction of profiled bars 1, 2. This has the advantage that insulating bar 3, as can be seen in FIG. 3, can be used in frame 1*a*, 2*a* as well as, in identical form, in sash 1*b*, 2*b*. Frame 1*a*, 2*a* here includes the complete composite profiled member 1, 2, 3, 4 and sash 1*b*, 2*b* includes the composite profiled member 1, 2, 3 without the elastic seal 4 and with an insulating bar 3 rotated by 180°.

Figure 4:
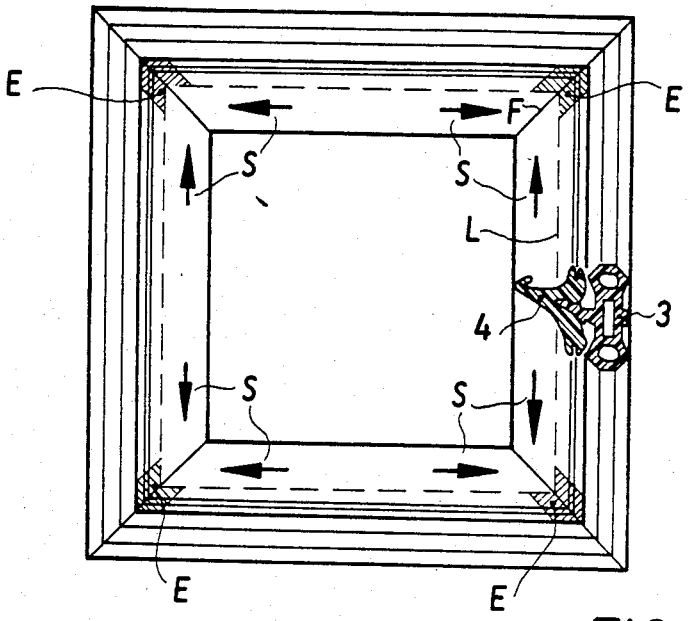
FIG. 4 is a view of an insulating bar assembled in the form of a frame with attached elastic center seal.

Extending in its longitudinal direction and in the center of its transverse axis Q, one generally flat side of insulating bar 3 is provided with an approximately perpendicularly oriented (vertically oriented as shown) profiled strip or rib 36. This strip or rib 36 is continuously profiled on one side 362 e.g. provided with barbs as shown. On the other side 361, strip 36 is profiled only at its foot end and at the top it has a smooth abutment face. An elastic center seal 4 can be pushed onto strip 36, as shown in FIG. 3. Strip 36, which projects into center seal 4 to approximately half its height, stiffens the center seal 4 to the dashed line L shown in FIG. 4. This has the advantage that the corner region E receives a precisely cut miter. Additionally, strip 36 makes it possible to install the center seal 4 in frame 1*a*, 2*a* in a compressed manner so that, in the corner region F above the dashed line L, due to its tendency to expand, center seal 4 tightly seals the miter even without adhesive, as shown by arrows S in FIG. 4.

Figure 5:
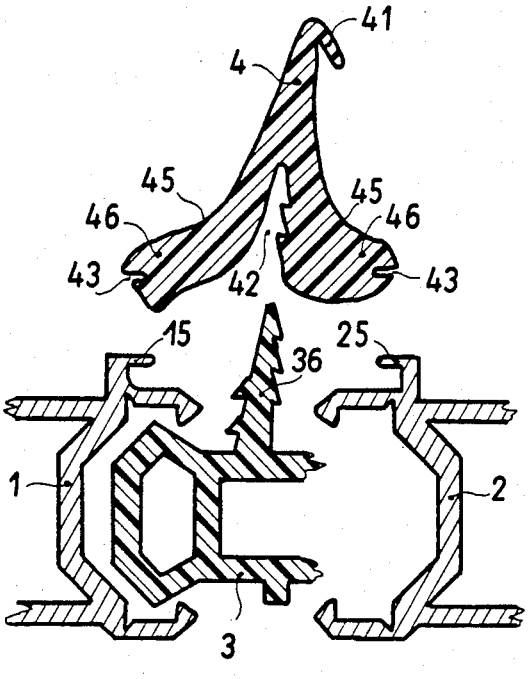
FIG. 5 is a sectional view of the elastic center seal and the composite profiled member.

FIG. 5 is a sectional view of the elastic center seal 4, of part of insulating bar 3 and of metal profiled bars 1, 2. Insulating bar 3 is combined with elastic seal 4 into a functional unit in that a force acting from outside in region 45 and in the direction toward insulating bar 3 pulls seal 4 and its receptacle 42 over the strip or rib 36, which reinforces the seal 4 and causes its feet 46 to be clamped or anchored in between strip or rib 36 and metal profiled bars 1, 2. To clamp or anchor the feet 46, grooves 43 are provided on both sides of the feet and strips or anchors 15, 25 are provided on metal profiled bars 1, 2. The finished composite profiled member is shown in the sectional view of FIG. 3. In this way it has become possible to cut the seal accurately by machine, and thus produce tight miters simultaneously with the cutting of the composite profiled members. FIG. 3 also shows how the elastic head portion 41 of the center seal 4 which is mounted on the frame 1*a*, 2*a* comes to rest against the smooth abutment face on side 361 of strip 36 of insulating bar 3 which is mounted in sash 1*b*, 2*b*.

What is claimed is:

1. In a composite profiled member including two metal profiled bars, and at least one thermally insulating, one-piece insulating bar having two generally flat sides and two opposed engaging sides, with each said engaging side engaging into a respective clamping groove on a respective one of said metal profiled bars and being fastened in the respective said clamping groove by respective hook-shaped groove webs which define the sides of each said clamping groove and which are pressed against said insulating bar, and wherein corresponding centering means are provided on said insulating bar and in each respective said clamping groove to assure dimensional accuracy when said groove webs are pressed against said insulating bar to fasten same; the improvement wherein: said centering means includes a bottom for each respective said clamping groove which is provided with a centering groove which has a trapezoidal cross section and widens in the direction toward said insulating bar, and a part of each said engaging side of said insulating bar which has a trapezoidal cross section that becomes narrower in the direction toward the facing one of said metal profiled bars with said part centeringly engaging in the respective said centering groove; an elastic seal is provided; and means are provided for fastening said seal to said insulating bar so as to stiffen said seal and precisely fix its position when said composite profiled bar is cut to length, said means for fastening including at least one rib which projects from one of said generally flat sides of said insulating bar, is shaped so as to fasteningly engage said seal, extends in the longitudinal direction of said insulating bar, and to which said elastic seal is fastened.

2. A composite profiled member according to claim 1, wherein the walls of each said centering groove extend in a direction parallel to the faces of said engaging sides of said insulating bar with which they centeringly cooperate.

3. A composite profiled member according to claim 1, wherein said insulating bar adjacent each said engaging side has a tubular shape.

4. A composite profiled member according to claim 1 wherein said engaging sides of said insulating bar have cross-sectional shapes which are symmetrical with respect to a cross-sectional axis.

5. A composite profiled member according to claim 4 wherein said rib projects approximately perpendicular to said one generally flat side of said insulating bar.

6. A composite profiled member according to claim 5 wherein said elastic seal has a recess in one surface which is pulled over said rib; and wherein said rib is provided with means for lockingly engaging the surface of said seal which defines said recess.

7. A composite profiled member according to claim 6 wherein said profiled metal bars are provided with anchor means for additionally fastening said elastic seal to said metal profile bars.

8. Windows, doors or the like according to claim 7 wherein said elastic seal is installed in a compressed manner so that it is tensioned in the longitudinal direction.

9. A composite profiled member according to claim 6 wherein said rib extends into said recess to approximately one half of the height of said seal.

10. A composite profiled member as defined in claim 6 wherein said elastic seal is installed in a compressed manner so that it has a bias in the longitudinal direction.

11. A frame for a window sash comprising: a composite profiled member, a first metal profiled bar, a second metal profiled bar, and an insulating bar which are connected together and define the plane of a window pane; an elastic center seal provided with a recess extending to approximately the one half of the height of said seal; and means, disposed on said composite member for engaging into said recess and for fastening said elastic center seal to said composite profiled member so that said recess is approximately parallel to said plane of said window, said means being formed of a stiffer material than the material of said elastic center seal.

12. A composite profiled member comprising a first metal profiled bar having an inner side, a second metal profiled bar having an inner side, and an insulating bar, said inner sides of said first and said second profiled bars facing each other and said insulating bar being arranged therebetween; and wherein:

a respective pair of deformable inwardly directed webs is disposed on each of said first and second metal profiled bars adjacent said inner sides for clamping said insulating bar in between said first and second metal profiled bars when said webs are deformed and pressed toward said insulating bar;

each of said inner sides of said first and second profiled bars is shaped to provide a respective centering groove for said insulating bar, with each said centering groove having a trapezoidal cross section with an opening angle which widens in the direction toward said insulating bar, and being flanked by a respective pair of said webs;

said insulating bar has a first and a second side which face said first and second metal profiled bars, respectively, which extend between the associated respective said pair of webs and which partially contact the respective said inner sides of said first and second profiled bars within the respective said centering grooves, said first and second sides of said insulating bar each having a trapezoidal cross section whose taper angle is at least as great as said opening angle of the contacted said centering groove; and, each respective pair of webs is deformed to engage said insulating bar behind the contacting portions of said first and second sides of said insulating bar, whereby said first and second metal profiled bars maintain a position at a precisely defined distance from one another which is the same as that which existed during deformation of said webs.

13. A composite profiled member as defined in claim 12 wherein said taper angles of said first and second sides of said insulating bar coincide with the respective said opening angles of said centering grooves.

14. A composite profiled member as defined in claim 12 wherein said taper angles of said first and second sides of said insulating bar are slightly larger than the respective said opening angles of said centering grooves.

15. A composite profiled member as defined in claim 12 further comprising: at least one rib which projects from a further side of said insulating bar and which extends in the longitudinal direction of said insulating bar and approximately central to the cross-sectional axis of said insulating member extending between said first and second profiled bars, said rib being oriented approximately perpendicular to said cross-sectional axis and being shaped so as to fasteningly engage an elastic seal which is pullable over said rib.

16. Windows, doors or the like, comprising a frame and a sash each formed of composite profiled members according to claim 15; an elastic seal pulled over and fastened to said rib of said insulating bars of said composite profiled members forming said frame; and, said insulating bars of said frame are rotated by 180° relative to said insulating bars of said sash so that said ribs of said insulating bars of said frame and said sash face one another.

17. A window, door or the like as defined in claim 16 wherein: said elastic seal has a recess in one surface; and, said rib has a height such that it extends into said recess to approximately one half of the height of said elastic seal, whereby said elastic seal is stiffened by said rib.

* * * * *